US006962485B2

(12) United States Patent
Bennett et al.

(10) Patent No.: US 6,962,485 B2
(45) Date of Patent: Nov. 8, 2005

(54) CONSTANT BYPASS FLOW CONTROLLER FOR A VARIABLE DISPLACEMENT PUMP

(75) Inventors: George L. Bennett, Hebron, CT (US); William H. Dalton, Amston, CT (US); Raymond D. Zagranski, Somers, CT (US)

(73) Assignee: Goodrich Pump and Engine Control Systems, Inc., West Hartford, CT (US)

( * ) Notice: Subject to any disclaimer, the term of this patent is extended or adjusted under 35 U.S.C. 154(b) by 0 days.

(21) Appl. No.: 10/639,056

(22) Filed: Aug. 12, 2003

(65) Prior Publication Data

US 2004/0200459 A1 Oct. 14, 2004

Related U.S. Application Data

(60) Provisional application No. 60/462,652, filed on Apr. 14, 2003.

(51) Int. Cl.[7] ..... F04B 40/24

(52) U.S. Cl. ..... 417/213; 417/302; 417/304; 417/308

(58) Field of Search ..... 60/39.281, 778, 60/734; 417/213, 302, 304, 308, 310

(56) References Cited

U.S. PATENT DOCUMENTS

| | | | |
|---|---|---|---|
| 2,322,568 | A | 6/1943 | DeLancey |
| 2,490,115 | A | 12/1949 | Clarke |
| 2,600,632 | A | 6/1952 | French |
| 2,606,503 | A | 8/1952 | Shaw |
| 2,639,585 | A | 5/1953 | Camerota |
| 2,755,740 | A | 7/1956 | Alston |
| 2,799,995 | A | 7/1957 | Herman |
| 2,907,279 | A | 10/1959 | Carleton |
| 2,975,717 | A | 3/1961 | Rynders et al. |
| 3,153,984 | A | 10/1964 | Fiske |
| 3,695,789 | A | 10/1972 | Jansson |
| 3,723,025 | A | 3/1973 | Coakley |
| 3,752,189 | A | 8/1973 | Marr et al. |
| 3,792,936 | A | 2/1974 | Pettibone et al. |
| 3,812,765 | A | 5/1974 | Himmler |
| 3,958,494 | A | 5/1976 | Miller |
| 4,198,195 | A | 4/1980 | Sakamaki et al. |

(Continued)

FOREIGN PATENT DOCUMENTS

DE 24 05 112 A 8/1975

(Continued)

OTHER PUBLICATIONS

Wong T.H. "Designing and Simulating the Engine Speed Governor for Helicopter Applications" ASME International Gas Turbine And Aeroengine Congress And Exposition, Jun. 5-8, 1995, —XP008021719—the whole document.

(Continued)

*Primary Examiner*—Charles G. Freay
(74) *Attorney, Agent, or Firm*—Edwards & Angell, LLP; Scott D. Wofsy, Esq.; George N. Chaclas, Esq.

(57) ABSTRACT

A fuel metering unit for controlling a variable displacement pump including a main metering valve in fluid communication with the pump for metering an output of the pump, a pressure regulator in fluid communication with the metering valve to create a spill return and a control valve in fluid communication with the pressure regulator and the pump for regulating the spill return flow so the spill return flow is maintained substantially constant at a low level to minimize the heat generated by recirculation by setting a displacement of the pump.

21 Claims, 1 Drawing Sheet

U.S. PATENT DOCUMENTS

| | | | |
|---|---|---|---|
| 4,325,215 | A | 4/1982 | Yamamoto |
| 4,338,965 | A | 7/1982 | Garnjost et al. |
| 4,342,545 | A | 8/1982 | Schuster |
| 4,348,159 | A | 9/1982 | Acheson |
| 4,443,159 | A | 4/1984 | Dantlgraber |
| 4,496,290 | A | 1/1985 | Nonnenmacher |
| 4,531,898 | A | 7/1985 | Ideta |
| 4,540,347 | A | 9/1985 | Child |
| 4,558,998 | A | 12/1985 | Kiyoshige et al. |
| 4,567,813 | A | 2/1986 | Garnjost |
| 4,768,540 | A | 9/1988 | Mochizuki et al. |
| 4,770,612 | A | 9/1988 | Teubler |
| 4,971,535 | A | 11/1990 | Okada et al. |
| 5,035,254 | A | 7/1991 | Blatter et al. |
| 5,141,418 | A | 8/1992 | Ohtaki et al. |
| 5,168,704 | A | 12/1992 | Kast et al. |
| 5,174,339 | A | 12/1992 | Pickard |
| 5,178,525 | A | 1/1993 | Murota |
| 5,209,058 | A | 5/1993 | Sparks et al. |
| 5,235,806 | A | 8/1993 | Pickard |
| 5,266,018 | A | 11/1993 | Niemiec |
| 5,357,935 | A | 10/1994 | Oxley et al. |
| 5,413,466 | A | 5/1995 | Bennett et al. |
| 5,435,718 | A | 7/1995 | Briggs |
| 5,448,882 | A | 9/1995 | Dyer et al. |
| 5,484,271 | A | 1/1996 | Stich |
| 5,505,592 | A | 4/1996 | Kumangai et al. |
| 5,518,380 | A | 5/1996 | Fujii et al. |
| 5,538,400 | A | 7/1996 | Konishi et al. |
| 5,545,018 | A | 8/1996 | Sundberg |
| 5,562,432 | A | 10/1996 | Semba et al. |
| 5,613,535 | A | 3/1997 | Loen |
| 5,690,479 | A | 11/1997 | Lehmann et al. |
| 5,715,674 | A | 2/1998 | Reuter et al. |
| 5,716,201 | A | 2/1998 | Peck et al. |
| 5,733,109 | A | 3/1998 | Sundberg |
| 5,738,500 | A | 4/1998 | Sundberg et al. |
| 5,800,131 | A | 9/1998 | Lehmann et al. |
| 5,806,300 | A | 9/1998 | Veilleux, Jr. et al. |
| 5,833,438 | A | 11/1998 | Sundberg |
| 5,895,209 | A | 4/1999 | Miyazawa |
| 5,896,737 | A | 4/1999 | Dyer |
| 5,951,240 | A | 9/1999 | Mirsky et al. |
| 6,102,001 | A | 8/2000 | McLevige |
| 6,412,271 | B1 * | 7/2002 | Maker et al. ..... 60/39.08 |
| 6,508,225 | B1 | 1/2003 | Hiki |
| 6,578,777 | B2 | 6/2003 | Bui |

FOREIGN PATENT DOCUMENTS

| | | |
|---|---|---|
| DE | 43 15 448 A | 12/1993 |
| EP | 0 070 529 A | 1/1983 |
| EP | 0 397 041 A | 11/1990 |
| EP | 0 677 661 A | 10/1995 |
| EP | 1 048 842 A2 | 11/2000 |
| FR | 2 764 336 | 11/1998 |

OTHER PUBLICATIONS

Morrison T. Howlett J.J., Zagranski R.D. "Adaptive Fuel Control Feasibility Investigation for Helicopter Applications" 27th ASME International Gas Turbine Exhibit—p. 3, column 1—p. 4, column 2; figure 3, date unknown.

A *copy* of the International Search Report dated Dec. 1, 2004, issued in corresponding international application No. PCT/US04/11368, filing date Apr. 13, 2004.

A *copy* of the Written Opinion dated Dec. 1, 2004, issued in corresponding international application No. PCT/US04/11368, filing date Apr. 13, 2004.

* cited by examiner

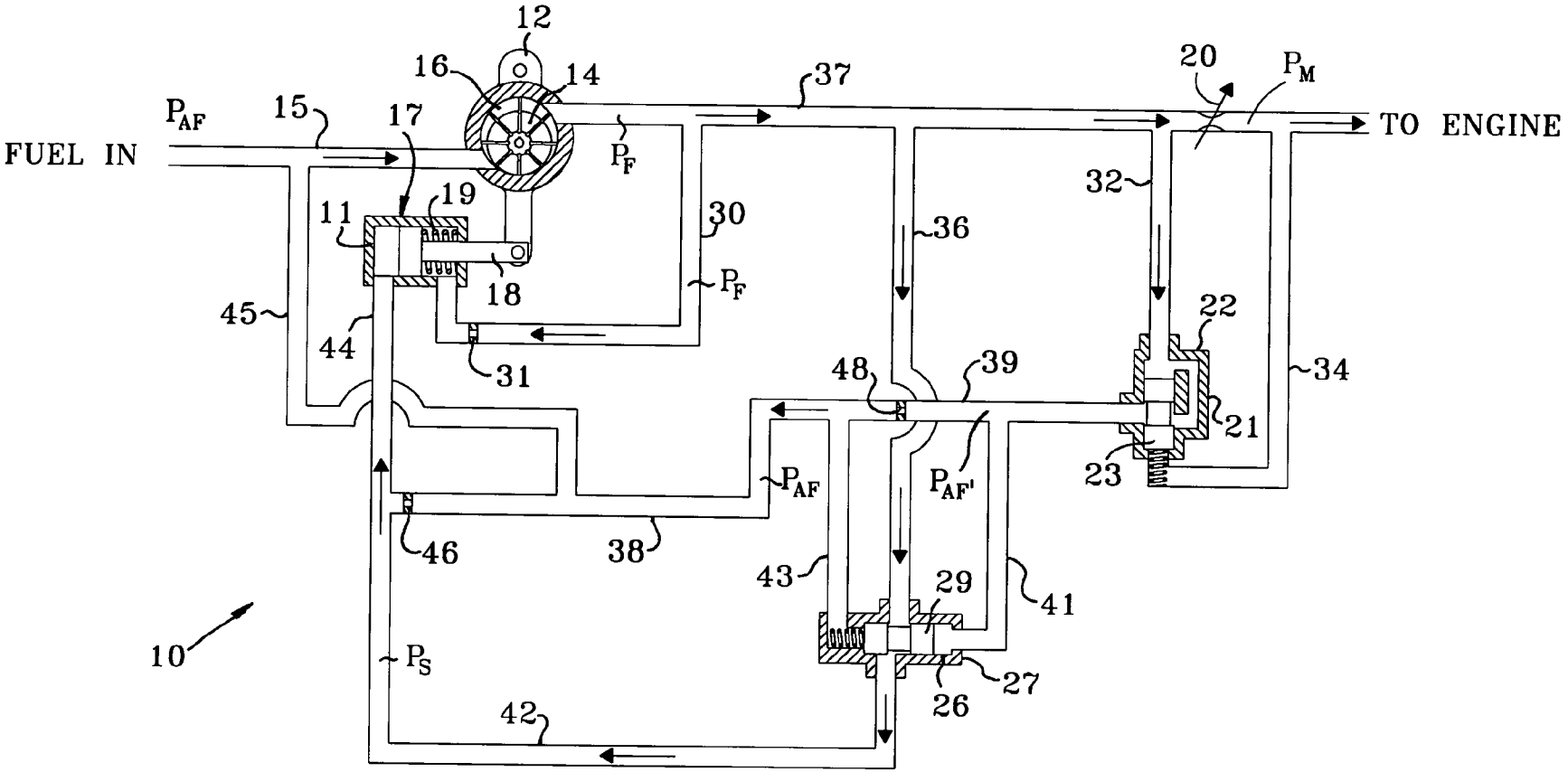
TO ENGINE
FUEL IN
$P_M$
$P_{AF}$
$P_F$
$P_{AF'}$
$P_S$
10
11
12
14
15
16
17
18
19
20
21
22
23
26
27
29
30
31
32
34
36
37
38
39
41
42
43
44
45
46
48

CONSTANT BYPASS FLOW CONTROLLER FOR A VARIABLE DISPLACEMENT PUMP

CROSS-REFERENCE TO RELATED APPLICATION

This application claims priority to U.S. Provisional Patent Application No. 60/462,652, filed Apr. 14, 2003, which is incorporated herein by reference.

BACKGROUND OF THE INVENTION

1. Field of the Invention

The subject invention is directed generally to a system for regulating fluid flow, and more particularly, to a system for regulating the flow of fuel from a variable displacement pump utilizing bypass flow.

2. Background of the Related Art

Fixed delivery fuel pumps have often been sized to provide excessive fuel flow capacity in order to insure adequate supply to the associated engine. Consequently, under many operating conditions, large amounts of pressurized fuel are returned to the pump inlet for recirculation. The return and recirculation results in significant fuel heating due to additional energy being put into the fuel which is subsequently turned into heat as the pressure drops in the recirculation path. In modern designs, fuel heating is a critical issue because the fuel is typically used as a heat exchanger to maintain proper operating temperature. Other methods of heat exchange are undesirable because of the associated size, weight and cost.

Variable displacement fuel pumps have partially overcome the drawbacks of fixed delivery pumps by being able to vary the amount of fuel output. By varying the fuel output, the fuel delivered more closely matches engine demand. Thus, the recirculated flow, along with the heat generated thereby, is reduced. Variable displacement fuel pumps are known in the art, as disclosed in U.S. Pat. No. 5,833,438 to Sunberg, the disclosure of which is herein incorporated by reference in its entirety. A variable displacement pump typically includes a rotor having a fixed axis and pivoting cam ring. The cam ring position may be controlled by a torque motor operated servo valve. However, the engine operating conditions often include transients such as those caused by engine actuator slewing, start-up and the like as would be appreciated by those of ordinary skill in the pertinent art. Under such rapidly varying operating conditions, prior art pump control systems have been unable to respond quickly and adequately. So despite this, variable displacement pumps still do not respond quickly enough to varying engine demands so excess fuel flow is still common.

In view of this shortcoming, control systems to fully utilize variable displacement fuel pumps have been developed. Examples of variable displacement pump control arrangements are disclosed in U.S. Pat. No. 5,716,201 to Peck et al. and U.S. Pat. No. 5,715,674 to Reuter et al., the disclosures of which are herein incorporated by reference in their entirety. Typical pump control systems attempt to maintain accurate fuel flow throughout the range of engine operating conditions. However, such systems still contain inadequacies such as instability, insufficient bandwidth. Moreover, such systems are still prone to delivering excessive fuel which must be recirculated. The pump control systems may include sophisticated electronics and numerous additional components to undesirably increase costs and complicate the pump control system.

In view of the above, it would be desirable to provide a pump control system which accurately and quickly regulates the output flow of a variable displacement pump without the associated drawbacks of the prior art.

SUMMARY OF THE INVENTION

The subject invention is directed to a pump control system for a variable displacement fuel pump such that the pump displacement exceeds the required steady state flow of the associated engine by an amount sufficient to accommodate flow transients and the bypass flow is maintained at a substantially constant acceptable level, i.e. small enough to prevent excessive heating.

In accordance with a preferred embodiment of the subject invention, the advantages of the present disclosure are accomplished by employing a constant bypass flow regulator with fuel metering to set the displacement of the pump.

It is an object of the present disclosure to increase the fuel metering unit bandwidth while maintaining acceptable stability at all operating conditions.

It is another object to provide a hydromechanical fuel metering unit for a variable displacement pump.

It is still another object to provide a fuel metering unit that achieves quick and accurate response to dynamic flow conditions.

In a preferred embodiment, the present invention is directed to a fuel metering unit for controlling a variable displacement pump including a metering valve in fluid communication with the pump for metering an output of the pump, a pressure regulator in fluid communication with the metering valve to create a spill return flow and a control valve in fluid communication with the pressure regulator and the pump for regulating the spill return flow so the spill return flow is maintained substantially constant by setting a displacement of the pump.

BRIEF DESCRIPTION OF THE DRAWINGS

So that those having ordinary skill in the art to which the subject invention appertains will more readily understand how to make and use the same, reference may be had to the drawing wherein:

The Sole FIGURE is a schematic representation of the fuel control system of the subject invention which includes a variable displacement vane pump, a bypassing pressure regulator and a control valve that maintains substantially constant bypass flow at a sufficient level to accommodate flow transients encountered during engine operation while minimizing the heat generated by recirculation.

DETAILED DESCRIPTION OF PREFERRED EMBODIMENTS

Referring now to Sole FIGURE, there is illustrated a schematic representation of the fuel control system of the subject invention which is designated generally by reference numeral 10. For clarity throughout the following description, arrows are shown within the lines of system 10 to indicate the direction in which the fuel flows and an annotated letter "P" is shown to indicate a pressure at certain locations. All relative descriptions herein such as left, right, up, and down are with reference to the system 10 as shown in Sole FIGURE and not meant in a limiting sense. Additionally, for clarity common items such as filters and shut off solenoids have not been included in the schematic representation of Sole FIGURE. System 10 is illustrated in association with a variable displacement vane pump 12. System 10 maintains the output flow of the pump 12 to meet engine needs yet advantageously minimizes recirculation, e.g., spill return flow which prevents excessive energy from being imparted to the fuel.

Pump 12 includes a rotor 14 and a pivoting cam ring 16. For a detailed description of a variable displacement vane pump, see U.S. Pat. No. 6,623,250 to Zagranski et al. issued Sep. 23, 2003 which is incorporated herein by reference in its entirety. Pump 12 receives fuel flow from line 15 at an inlet pressure $P_{AF}$, and delivers fuel flow at an output pressure $P_F$ into line 37. A piston 18 is operatively connected to the cam ring 16 to control the position of the cam ring 16 relative to the rotor 14, and in turn vary the output flow of the pump 12. A half area servo 17 positions piston 18 within housing 11. It would be appreciated by those of ordinary skill in the art that other types of servos similarly and differently arranged would perform this same function and are, therefore, considered mere design choices. For example without limitation, an equal area servo could be utilized as servo 17. The maximum flow setting of pump 12 occurs when the piston 18 is moved the maximum distance to the left. A feedback line 30 provides fuel at pressure $P_F$ to one inlet of the half area servo 17. An orifice 31 in line 30 dampens the motion of the piston 18. It will be appreciated by those of ordinary skill in the art that line 30 may connect the half area servo 17 to a variety of sources while still maintaining the required performance for the preferred embodiment. Line 44 provides pressure to the other inlet of half area servo 17 as is described below. Spring 19 is sized and configured to bias piston 18 to maximum flow for start up of pump 12. Throughout system 10, springs are sized as a function of the product of piston area and fuel pressure as would be appreciated by those of ordinary skill in the art and therefore not further described herein.

Main metering valve 20 is disposed in line 37 between the pump 12 and engine (not shown) for providing fuel to the engine at a selected rate and pressure $P_M$. Suitable main metering valves 20 are well known in the prior art and therefore not further described herein. A variety of metering valves 20 may be utilized as long as the selected valve performs the function of selectively varying the amount of fuel which may pass through to the engine.

A bypassing pressure regulator 22 is connected to line 37 through spill return flow line 32 and static sensing line 34. Regulator 22 includes a housing 21 defining an interior with a spring-biased spool 23 operatively disposed therein. Spill return flow line 32 contains fuel flowing therethrough in accordance with the relationship ($P_F$–$P_M$), e.g., the spill return flow. Static sensing line 34 has no flow but provides pressure to the spool 23 of regulator 22 at pressure $P_M$. The flow exits from the pressure regulator 22 into line 39 at a pressure $P_{AF'}$, and passes through a bypass flow sensing orifice 48 into line 38. Fuel in line 38 recirculates to the pump 12 by line 45, and passes into the half area servo 17 by line 44. Orifice 46 is disposed in line 38 to limit the fuel flow therethrough. Under static conditions, the pressure in line 44 is substantially half the pressure within line 30 hence the moniker "half area servo" 17 is appropriate.

The flow from pressure regulator 22 is also directed by lines 41, 43 to inputs of a control valve 26 that is in direct communication with the output flow from pump 12 by line 36 at a pressure $P_F$. Control valve 26 includes a housing 27 that defines an interior with a spring-biased spool 29 operatively disposed therein. During steady-state conditions, the control valve 26 maintains the displacement of the pump 12 and, in turn, the relationship ($P_{AF''}$–$P_{AF}$) across bypass flow sensing orifice 48. Thus, the bypass fuel flow from the pressure regulator 22 through the orifice 48 remains substantially constant. The fuel flow through orifice 48 is set at a sufficient level to accommodate transient events such as bleed actuators, engine slewing from maneuvers such as terrain avoidance, engine surging due to missile launching, and other like demands. The primary output flow from control valve 26 exits into line 42 at a servo pressure $P_S$ and is delivered to the half area servo 17 to act on the piston 18. The position of the piston 18 moves the cam ring 16 relative to the rotor 14 to determine the output of the pump 12.

During steady-state operation, the control valve 26 maintains bypass flow through orifice 48 at a relatively small level to prevent significant heating in the system 10. When a transient event occurs whereby the engine requires more fuel, main metering valve 20 responds by opening to immediately increase flow to the engine and starts a chain of events which leads to an increase in the output of the pump 12. The pump 12 cannot immediately respond with increased displacement so the incremental demand is filled by a reduced spill return flow in line 32. In effect, the control system 10 immediately responds. In response to the spill return flow decrease in line 32, spool 23 in pressure regulator 22 strokes up. As a result, the output in line 39 is decreased and, in turn, the pressure differential ($P_{AF''}$–$P_{AF}$) across orifice 48 decreases. When ($P_{AF''}$–$P_{AF}$) decreases, the spool 29 in control valve 26 strokes to the right to decrease the flow in line 42 and thereby the pressure in line 44 decreases which causes the piston 18 to move to the left. As a result, the output of pump 12 increases until the spill return flow in line 32 returns to the desired level and a steady-state condition is reached across orifice 48.

In the alternative, when the engine requires less fuel, main metering valve 20 responds by closing to decrease flow to the engine. As a result, the spill return flow in line 32 increases to start a chain of events which leads to a decrease in the output of the pump 12. In particular, spool 23 in pressure regulator 22 strokes down increasing the output in line 39 and, in turn, increasing the pressure differential ($P_{AF''}$–$P_{AF}$) across orifice 48. Spool 29 in control valve 26 strokes to the left and the pressure in lines 42, 44 increases which causes the piston 18 to move to the right. When the piston 18 moves to the right, the output of pump 12 decreases. Ultimately, the piston 18 shifts to the right until the spill return flow in line 32 returns to the desired steady-state level. When the spill return flow is at the desired level, ($P_{AF''-PAF}$) returns to the substantially constant steady-state level. Thus, control valve 26 reacts to the pressure differential across bypass sensing orifice 48 to reposition the pump 12 to maintain a desired spill return flow level and a substantially constant pressure across bypass sensing orifice 48. Accordingly, system 10 is a stable hydromechanical unit which can quickly respond to engine transients without unnecessary recirculation flow.

While the subject invention has been described with respect to preferred embodiments, those skilled in the art will readily appreciate that various changes and/or modifications can be made to the invention without departing from the spirit or scope of the invention as defined by the appended claims.

What is claimed is:

1. A fuel metering unit for controlling a variable displacement pump comprising:

a metering valve in fluid communication with the pump for metering an output of the variable displacement pump;

a flow line for creating a spill return flow from an output of the pump;

a pressure regulator in fluid communication with the flow line for receiving the spill return flow;

a control valve for regulating the spill return flow to a substantially constant small level to prevent excessive heat generation during recirculation by setting a displacement of the pump; and an orifice operatively connected to the output of the pressure regulator for creating a pressure differential across the control valve.

2. A fuel metering unit as recited in claim 1, further comprising a servo mechanism operatively connected to the spill return flow for determining the output of the pump and thereby the spill return flow.

3. A fuel metering unit as recited in claim 2, wherein the servo mechanism is a half area servo mechanism.

4. A fuel metering unit as recited in claim 2, further comprising a static pressure line between the output of the pump and the servo mechanism for facilitating a proper setting of the servo mechanism.

5. A fuel metering unit as recited in claim 1, further comprising a static flow line between the output of the main metering valve and the pressure regulator for facilitating a proper setting of the pressure regulator.

6. A fuel metering unit for controlling a variable displacement pump actuated comprising:

a servo mechanism for varying an output of the pump;

a metering valve operatively connected to the output of the pump and an engine such that actuation of the metering valve controls an output of the variable displacement pump so as to schedule fuel flow accurately to the engine;

a spill return flow line connected between the output of the pump and the metering valve;

a first regulator operatively connected to the spill return flow line such that a first pressure differential across the first regulator determines an output of the first regulator; and a second regulator operatively connected to the output of the first regulator and the servo mechanism such that the output of the first regulator is regulated during a steady-state condition, and during a transient condition, a second pressure differential across the second regulator varies to adjust an output of the second regulator to, in turn, adjust the servo echanism to vary the output of the pump such that a subsequent flow in the spill return line is substantially equal to a desired flow.

7. A fuel metering unit as recited in claim 6, further comprising a feedback line connected between the output of the pump and the servo mechanism.

8. A fuel metering unit as recited in claim 6, a static sensing line connected between the metering valve and the engine.

9. A fuel metering unit as recited in claim 6, a servo line connected between the pump and the metering valve.

10. A fuel metering unit for controlling a variable displacement pump comprising:

first means in fluid communication with the pump for metering an output of the pump;

second means in fluid communication with the first means to create a bypass flow for responding to transients;

third means in fluid communication with the second means and the pump for regulating the bypass flow so bypass flow is substantially constant by variably setting a displacement of the variable displacement pump; and fourth means for creating fluid communication between the output of the pump and the third means.

11. A fuel metering unit as recited in claim 10, wherein the first means is a metering valve.

12. A fuel metering unit as recited in claim 10, wherein the second means is a first regulator.

13. A fuel metering unit as recited in claim 10, wherein the third means is a second regulator.

14. A fuel metering unit as recited in claim 10, further comprising a fifth means operatively connected to the bypass flow for determining the output of the pump.

15. A fuel metering unit as recited in claim 14, wherein the fetwth fifth means is a servo mechanism.

16. A fuel metering unit as recited in claim 10, wherein the fourth means is a flow line.

17. A method for maintaining a constant spill return flow in a fuel metering unit that provides fuel to an engine, the method comprising the steps of:

metering an output of a variable displacement pump;

creating a spill return flow from the output of the variable displacement pump to allow for quick response when additional fuel is required by the engine;

regulating the output of the pump with a regulator based upon the spill return flow;

regulating an output of the fifst regulator with a control valve to maintain the spill return flow substantially constant, wherein an input of the control valve is in fluid communication with the output of the pump through a flow line separate from the spill return flow; and adjusting a displacement of the pump based upon an output of the control valve.

18. A method as recited in claim 17, further comprising the step of adjusting a position of a servo mechanism based upon the output of the control valve to determine the displacement of the pump.

19. A method as recited in claim 17, further comprising the step of creating a pressure differential between two inputs of the control valve to determine the output of the control valve.

20. A fuel metering unit for controlling a variable displacement pump comprising:

a metering valve in fluid communication with the pump for metering an output of the variable displacement pump;

a first flow line for creating a spill return flow from an output of the pump;

a pressure regulator in fluid communication with the flow line for receiving the spill return flow;

a control valve for regulating the spill return flow to a substantially constant small level to prevent excessive heat generation during recirculation by setting a displacement of the pump; and a second flow line connected to place the control valve in direct communication with an output of the pump.

21. A method for maintaining a constant spill return flow in a fuel metering unit that provides fuel to an engine, the method comprising the steps of:

metering an output of a variable displacement pump;

creating a spill return flow from the output of the variable displacement pump to allow for quick response when additional fuel is required by the engine;

regulating the output of the pump with a regulator based upon the spill return flow;

regulating an output of the regulator with a control valve to maintain the spill return flow substantially constant, the control valve being located in a flow line and having two control inputs;

adjusting a displacement of the pump based upon an output of the control valve; and creating a pressure differential between the two control inputs of the control valve to determine the output of the control valve.

* * * * *